United States Patent [19]

Kühfuss

[11] 4,453,707

[45] Jun. 12, 1984

[54] METHOD AND DEVICE FOR AUTOMATICALLY PROCESSING SHEET PILES OF NUMBERED MULTIPLE-NOTE SECURITY PAPERS, NOTABLY BANKNOTES, INTO BUNDLE PACKETS

[75] Inventor: Runwalt Kühfuss, Metzingen, Fed. Rep. of Germany

[73] Assignee: De La Rue Giori S.A., Switzerland

[21] Appl. No.: 391,974

[22] Filed: Jun. 24, 1982

[30] Foreign Application Priority Data

Aug. 10, 1981 [CH] Switzerland ..... 5120/81

[51] Int. Cl.[3] ..... B65H 39/08

[52] U.S. Cl. ..... 270/60; 53/54

[58] Field of Search ..... 270/58, 60; 194/DIG. 26; 53/54, 435, 447, 123, 520, 535, 540; 198/447

[56] References Cited

U.S. PATENT DOCUMENTS

| | | | |
|---|---|---|---|
| 3,888,267 | 6/1975 | Gautschi | 270/60 |
| 3,939,621 | 2/1976 | Giori | 53/54 X |
| 4,045,944 | 9/1977 | Giori | 53/54 X |
| 4,283,902 | 8/1981 | Giori | 53/435 X |

*Primary Examiner*—E. H. Eickholt

*Attorney, Agent, or Firm*—Kane, Dalsimer, Kane, Sullivan and Kurucz

[57] ABSTRACT

A pile of printed sheets comprising n×m banknotes per sheet are cut in a strip cutting unit into m strip piles and banded, the previously banded strip piles belonging to the same pile of sheets being gathered and delivered simultaneously as a group in the longitudinal direction of the strip piles to a bundle cutting unit and cut into n bundles per strip pile. The bundles are delivered sequentially to one of a pair of alternately filled and discharged magazine drums comprising each N magazines disposed at spaced angular intervals along their outer periphery and the drums are rotatably driven at a constant speed such that the bundles penetrate sequentially and separately into the successive magazines of the drum concerned in which every ten bundles of the same series are piled up and subsequently removed to form bundle packets. The number N of drum magazines corresponds to the maximum number $m_o \times n_o$ of banknotes possibly contained in a single sheet to be processed. If the number of printed notes per sheet is less than N, after cutting each group of strip piles $n_o$-n blank cycles are introduced before the first bundle cutting of the following group and in addition during the subsequent transport of the bundles, after each sequence of m bundles, $m_o$-m empty positions are introduced, so that in each case corresponding magazines of the drum remain free, whereby without changing the number of magazines printed sheets comprising different numbers of banknotes can be processed.

2 Claims, 5 Drawing Figures

METHOD AND DEVICE FOR AUTOMATICALLY PROCESSING SHEET PILES OF NUMBERED MULTIPLE-NOTE SECURITY PAPERS, NOTABLY BANKNOTES, INTO BUNDLE PACKETS

FIELD OF THE INVENTION

This invention relates in general to methods and devices for automatically processing, notably by sorting, sheet piles of numbered, multiple-note security papers, notably banknote sheets, into bundle packets, and is directed to provide various improvements in such methods and devices, notably those disclosed and illustrated in the U.S. Pat. Nos. 3,939,621 and 4,045,944 of the same Applicants.

BACKGROUND OF THE INVENTION

Generally, downstream of a numbering machine designed for printing sequential numbers on the printed security papers, piles comprising each 100 sheets are formed, so that after cutting these piles bundles comprising each 100 security papers are obtained. Then 10 bundles comprising altogether 1,000 sequentially numbered security papers are assembled automatically to form a single packet of 1,000 security papers. However, since all the security papers or banknotes printed on a same sheet belong to different series and the banknotes superimposed in a same pile of sheets are numbered with sequential numbers in each series, the bundles of security papers cut to format which leave the machine must be sorted into packets before packing them. During this sorting operation all the first bundles of the ten piles of sheets stacked in succession, then all the second bundles of these ten piles of sheets, and so forth, are superimposed to form packets eventually containing each 1,000 sequentially numbered security papers, each packet containing of course 10 bundles.

This constitutes an automatic transfer sorting process utilizing an intermediate storage device comprising preferably two magazine drums of same construction; one magazine drum is supplied with bundles of security papers until it is filled completely therewith, and the other magazine drum, previously filled with bundles of security papers, is discharged step by step, so that the resulting bundle packet is removed from each filled magazine and delivered to the packing machine. An automatic distributing device is disposed upstream of the two storage drums, so that when one drum is filled completely the next incoming bundle is directed uninterruptedly to the other empty drum which was discharged in the meantime.

Up to now the number of magazines disposed at spaced intervals around the outer periphery of a magazine drum was necessarily equal to the number of notes per sheet. Thus, when a machine had to be converted for use with a different type of security papers having a different number of printed notes per sheet, the operator was compelled to change the number of magazines in each drum to match this difference between the numbers of notes per sheet; of course, this change involved considerable labor and material expenditure, and in addition required a long change-over time.

The other component elements and subassemblies of the automatic sorting device could be adapted without any excessive labor and time expenditure both to the format of the processed sheets and to the number of notes per sheet. Thus, known automatic banknote cutting machines are constructed with a view to conveniently process sheets having p.e. 60 to 15 banknotes per sheet, said machines being adaptable to each specific case without requiring any excessive labor and time expenditure. Therefore, a modification in the number of notes per sheet being processed involves necessarily a tedious change-over of the magazine drums, which constitutes a bottleneck and increases considerably the machine downtime. This is inasmuch detrimental as automatic devices of this character are capable of operating with a maximum efficiency of the order of 480,000 banknotes per hour, so that longer change-downtimes are of particularly great importance.

The problem on which the present invention is based consists in so improving the above-mentioned method that sheets having different note numbers can be processed without changing the number of magazines in the drums.

This problem is solved according to the present invention by providing a method and a device of the type set forth, whereby, by resorting to a simpler programming of the apparatus controlling the forward feed and the cutting mechanism, it is possible, independently of the number of notes per sheet, to obtain a working period corresponding to the processing of a complete pile of sheets, which results from the number of working cycles and from the number of blank cycles fitting in the normal working rate which is constant in time and equal to the time required for the drum magazines to accomplish a single revolution, when operating constantly with the same number of magazines; what varies according to the number of notes is the ratio of working cycles to blank cycles and also the number and distribution of the magazines filled with bundles.

THE DRAWINGS

FIG. 1 is a diagrammatic plan view from above illustrating a typical form of embodiment of a machine incorporating the method and device of this invention, and FIGS. 2*a* to 2*d* are diagrammatic views illustrating the distribution of filled and unfilled magazines of a magazine drum in four different cases of modes of distribution of the numbers of banknotes per sheet.

DESCRIPTION OF THE PREFERRED EMBODIMENT

Figure 1:
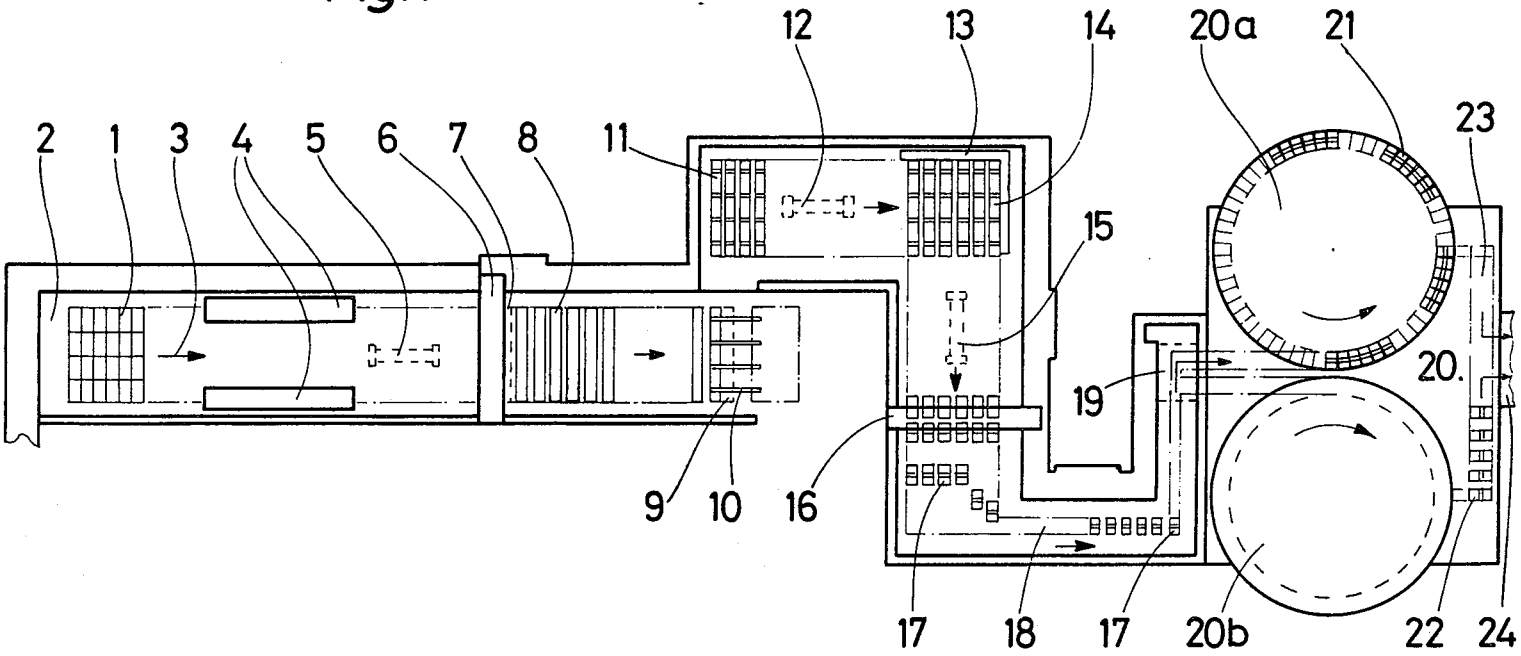

Referring first to FIG. 1 of the drawings, each sheet pile 1 to be processed consists of 100 sheets comprising previously numbered and printed banknotes, said sheets being fed in the proper number sequence to the lay-out arrangement 2 of an automatic cutting machine. The sheet piles are delivered from the outlet of a conventional banknote numbering machine.

In the example illustrated each sheet 24 has 24 printed banknotes forming a matrix divided into six rows extending across the direction of feed of the pile 1 during the cutting thereof (in the direction of the arrow 3), and forming four columns extending in the direction of feed. The banknotes superimposed in each sheet pile pertain each time to a predetermined series number and are numbered sequentially within this series.

The automatic cutting machine comprises two parallel opposed longitudinal cutting units 4, a transverse cutting unit 6 for cutting the strips and an additional transverse cutting unit 16 for cutting the bundles.

The pile of sheets 1 is delivered in the direction of the arrow 3 to both longitudinal cutting units 4 having its cutters oriented in the direction of feed and adapted to cut simultaneously the marginal portions of the sheets in each pile. With the assistance of an electronically programmable forward feed apparatus 5 the pile 1 of sheets is then delivered to the transverse cutting unit 6 comprising a cutter extending at right angles to the transport direction. Here firstly an edge trimming of the leading side of the pile of sheets takes place, whereafter the pile of sheets is divided step by step into its six strip piles or layers, and finally the trailing edge of the last strip pile is trimmed in turn. The paper cutting fall through a discharge trap 7. When one pile of sheets is divided, the next pile of sheets is delivered automatically to this cutting unit 6.

The strip piles 8 are fed separately to a banding station 9 comprising in the example illustrated four banding devices operating simultaneously and receiving four pre-sized bands 10 which are caused to encircle simultaneously each strip pile 8 at the four security-paper or banknote positions. The simultaneous banding of a strip pile is well known in the art and notably through U.S. Pat. No. 4,283,902 delivered to the same Applicants.

The finished banded strip piles 11, as shown by the arrows, are then firstly moved away from the banding station 9 in the longitudinal direction of the strips, and subsequently, after a change of direction of 90° in the direction of feed, delivered by means of an electronically programmable feed device 12 across the longitudinal direction of the strips to a locating station 13. Here, the six strip piles 11 belonging to the same sheet pile 1 are assembled, aligned and slidably gathered to form a group 14 of contiguous strip piles which, by means of an electronically programmable feed device 15, are delivered simultaneously to the transverse cutting unit 16 consisting of a cutter extending across and above all the strip piles. Here, all the six strip piles 11 are simultaneously cut step by step into separate, already banded bundles 17, whereby in the example illustrated three cuts are necessary since each strip pile or each original row of sheets comprises four banknotes.

The bundles 17 cut to the required formal and banded are moved forward automatically on a conveyor path 18 and delivered thereby with a predetermined relative spacing to a distribution station 19 and from the latter to an intermediate storage unit 20 comprising rotary magazine drums 20 and **20*b*. The distribution station 19 and the intermediate storage unit 20, as well as their functions, are disclosed in the U.S. patents mentioned in the preamble of this specification. Each one of said magazine drums 20*a* and 20*b* comprises a predetermined number of magazines 21 disposed at spaced angular intervals along its outer periphery. The magazine drums are adapted to be rotatably driven in the direction of the arrows at a speed such that the bundles 17 belonging originally to the same pile of sheets 1 are dropped sequentially into different magazines 21 of one drum during a complete revolution of this one drum, in the example of FIG. 1 drum 20*a*, and that the following bundle 17 deriving from the next pile of sheets, during the next complete revolution of the same one drum, drop into the same magazine 21, respectively, and so forth. Thus, all the bundles 17 deriving from ten successive piles of sheets 1 and having each time the same banknote position on the sheet, are superimposed in stacked relationship in one of the magazines 21 of drum 20*a* until ten bundles are collected in the magazines concerned. Since in the numbering machine, which printed the sheet numbers before forming the pile 1 of sheets, the same positions or banknotes of successive sheets were numbered sequentially within one series, the 1,000 banknotes of all the bundles 17 forming a bundle packet 22** made of ten bundles belong to the same series and are numbered sequentially.

When the magazine 21 of said one magazine drum 21 has been filled completely, the next bundles 16 in distribution station 19 are diverted automatically to the other magazine drum **20*b* where the above-described sorting operating is repeated. At the same time, the completely filled magazine drum 20*a* is discharged step by step, whereby the bundle packets 22, as illustrated in FIG. 1 for the other drum 20*b*, are extracted sequentially from each magazine 21 and delivered by means of a feed system 23 onto a conveyor path 24. On this conveyor path 24 a further processing of the bundle packets 22** takes place, and these packets after being counted another time are automatically banded and packaged.

Up to now it was necessary that the number of magazine disposed at spaced angular intervals along the outer periphery of the magazine drums **20*a* and 20*b* be equal to the number of notes per sheet of security papers printed on each sheet. In the example illustrated in FIG. 1 it was therefore necessary heretofore to utilize magazine drums comprising 24 magazines each, since the complete device was so designed that piles of sheets following one another were cut without pause in strip piles and the sequential groups 14 of strip piles were cut without pause in bundles 17, which were fed continuously on the conveyor path 18 to the intermediate storage means 20. Under these circumstances, it was of course necessary that, to obtain in the magazines 21 packets comprising the proper sequence of numbered banknotes, the number of these magazines 21 be equal to the number of banknotes per sheet. Now, however, the number of banknotes per sheet may vary within wide limits, for example from $4\times6=24$ banknotes as in the example illustrated to a maximum number, generally of $6\times10=60$ banknotes per sheet. Furthermore, and consequently, in order to enable sheets comprising a different number of banknotes to be processed by means of the above-described device, it was necessary not only to adapt the control of the cutting machine and the usual appliances to each sheet format and to the number of banknotes per sheet, but also to so reset the magazine drums 20*a* and 20*b* that the number of magazines 21** uniformly distributed along its outer periphery be equal to the number of banknotes per sheet. This resetting constituted however a complicated and time-robbing operation.

According to the present invention, each one of the magazine drums **20*a* and 20*b* comprises a fixed number N of magazines 21 which is equal to the maximum possible number of banknotes provided in the sheets to be processed. In the example illustrated $N=60$, this number corresponding to the generally maximum number of banknotes, i.e. $6\times10=60$ banknotes per sheet, in which the banknotes are therefore arranged in 10 rows and 6 columns. In order to permit the processing of sheet piles with these drums without changing their number of magazines, and also of sheets comprising a lesser number of notes, a number of blank cycles were introduced into the normal rate of operation, during the cutting and also during the feed, in such a way that the sum of working cycles and blank cycles corresponding to a complete pile of sheets be equal to the sum of working cycles when processing a 60-banknote sheet and therefore to a complete revolution of a magazine drum 20*a*** or 20*b*, in which a corresponding number of magazines remain free each time.

For this purpose, in the example illustrated the processing of sheets comprising $4\times6=24$ banknotes will be controlled as follows: the device 5 for feeding the piles of sheets 1 and the cutting rate of cutting units 4 and 6 are independent of the feed means for strip piles 11, the groups 14 of strip piles, and the bundles 17 as well as the cutting rate of cutting unit 16 are adjustable and so selected that the working period for cutting completely a sheet pile 1 in a strip pile 8 is therefore equal to the working period necessary for cutting a sheet comprising 10 rows of banknotes, that is, the maximum number of rows. The subsequent working procedure, until the groups 14 of strip piles 11 are gathered at locating station 13, and therefore the feeding of individual strip piles 8, the banding thereof in banding station 9 and the subsequent delivery thereof to locating station 13, take place in such a way that within each one of the above-defined working periods a complete group 14 of six strip piles 11 is formed.

After feeding a group 14 of strip piles to cutting unit 16 and cutting them thereat cyclically at the normal working rate into bundles 17, before the beginning of the forward feed, two blank cycles or idle cuttings are introduced into the following group 14 of the strip piles, so as if the strip piles would comprise ech the maximum number of six notes. During these two blank cycles it is of course unnecessary that the cutting unit 16 performs any cutting movement. Consequently, the next group 14 of strip piles is separated from the preceding group by a distance equal to the space required for two banknotes, measured in the longitudinal direction of the strip pile. The six bundles 17 cut to format and leaving the cutting unit 16 after each cutting step are so fed to the conveyor path 18 as shown in FIG. 1 that they are shifted thereat one by one, and directed at spaced intervals on a same line of conveyor path 18 to the intermediate storage means 20, where they are caused to drop into six adjacent magazines 21 of a loading magazine drum 20*a*.

The delivery of the next sequence of six bundles 17 fed one by one to the conveyor path 18 will however be delayed by four blank cycles, so that two adjacent sequences each comprising six bundles 17 will be separated from each other by four empty positions. Following the last one of the four series of bundles all belonging to the same pile 1 of sheets, each series comprising six bundles 17, on account of the above-described pair of blank cycles or cuttings, a gap comprising on the whole 24 empty positions is formed on conveyor path 18 until the first one of the series of bundles pertaining to the four subsequent piles of sheet is received. These 24 empty positions result on the one hand from the four empty positions following the last sequence of bundles and on the other hand from the two times ten empty positions resulting from the two blank cycles preceding the delivery of the next group 14, in connection with the four blank positions following this group. The procedure during the transfer of bundles 17 from cutting unit 16 to conveyor path 18 would also take place in all cases wherein the maximum number of ten strip piles and in each strip pile the maximum number of six bundles were available.

Due to the above-described gaps or empty position on the conveyor path 18, the magazines 21 of magazine drum 20*a* will be filled as shown in FIG. 1, wherein the magazines filled with bundles are evidenced by the presence of the bundle encircling bands.

If the reference symbol $m_o$ designates in general the maximum number of rows of banknotes per sheet, this is consequently the maximum number of banknotes in the direction of feed of the pile 1 of sheets when moving past the cutting unit 6 of the maximum number of strip piles 8 per pile 1 of sheets, and $n_o$ designates the maximum number of columns of banknotes, which consequently is the maximum number of banknotes across the direction of feed or the number of bundles 17 per strip piles 8, and therefore if $N=m_o\times n_o$ the maximum number of banknotes per sheet, the method of the present invention, when processing sheets comprising $m\times n$ banknotes, wherein m is less than $m_o$ and/or n is less than $n_o$, may be described as follows:

After the simultaneous cutting of m strip piles, assembled in a group 14 and all derived from one and same pile 1 of sheets, with n bundles per strip pile, $(n_o-n)$ blank cycles or cutting are allowed to take place, thus forming a gap between this group and the next group of strip piles derived from the following pile 1 of sheets, this gap corresponding to the length of $(n_o-n)$ banknotes measured in the longitudinal direction of the strip piles. Consequently, this control of the feed and of the cutting of strip piles into bundles takes place with the addition of blank cycles as if each strip pile had the maximum permissible number of $n_o$ banknotes. Then, the forward feed of the bundles 17 leaving the cutting unit 16 takes place as if in each case the maximum number $m_o$ of strip piles per pile of sheets were available; then, in each case a series of bundles comprising m bundles is transported on conveyor path 18, and $(m_o-m)$ empty positions are introduced into this conveyor path 18 before the next series of m bundles is delayed. Finally, in the last one of the series of bundles derived from a predetermined pile of sheets, $(m_o-m)+(n_o-n)$ blank positions are obtained.

FIGS. 2*a* to 2*d* illustrate diagrammatically in the case of magazine drums comprising sixty magazines ($N=60$) and four different numbers of banknotes per sheet, the distribution of the empty or blank magazines, which corresponds of course to the distribution of empty positions on conveyor path 18. In the case $n=6$ and $m=8$ (according to FIG. 2*a*), there are two empty magazines every eight filled magazines, since in fact n equals the maximum number $n_o$ of bundles per strip piles.

If $n=5$ and $m=8$ (according to FIG. 2*b*), in each case eight adjacent magazines are filled, the next two magazines are empty and in addition, since only five bundles per strip pile are available, the last ten magazines are likewise empty.

The case $n=4$ and $m=6$ according to FIG. 2*c* has already been discussed with reference to the exemplary form of embodiment of FIG. 1.

Figures 2A, 2B, 2C, 2D:
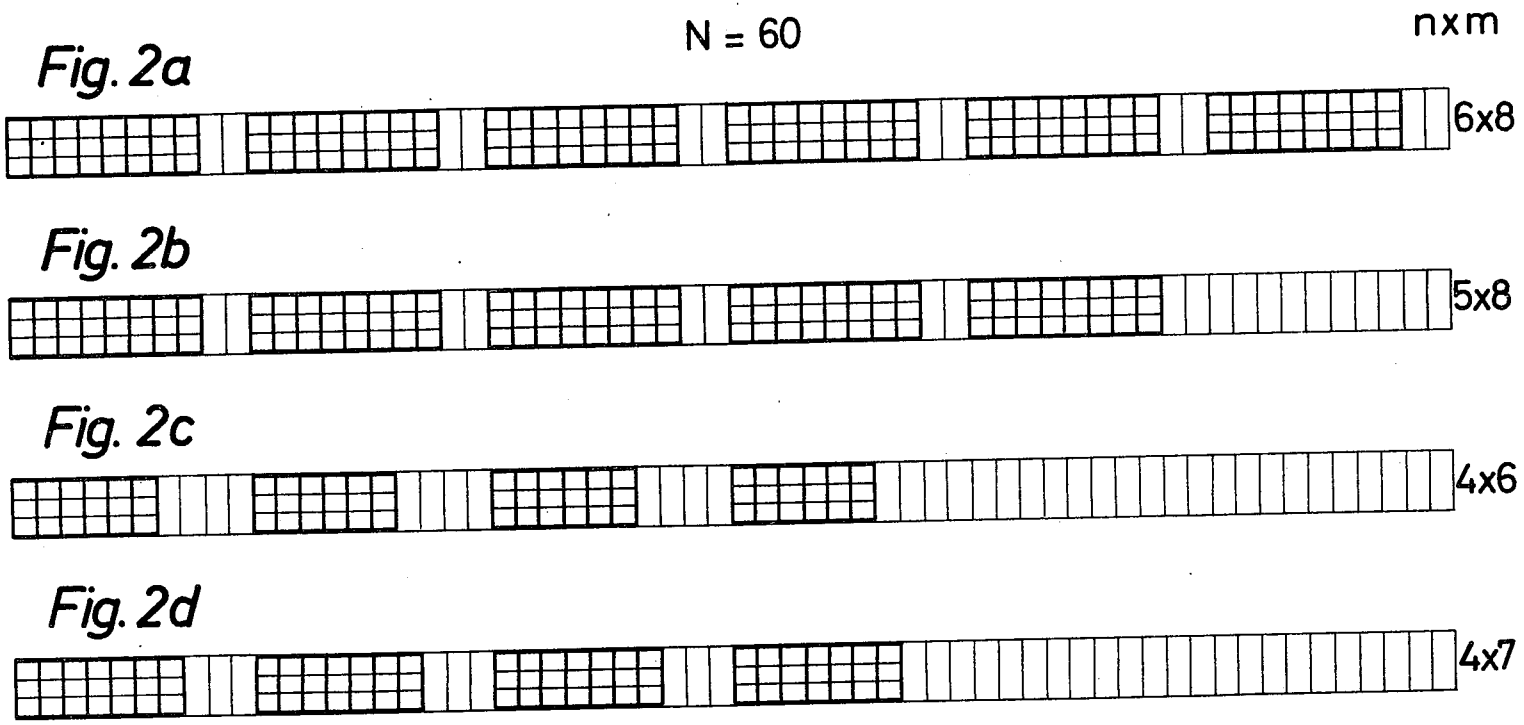

FIG. 2*d* shows the case in which $n=4$ and $m=7$, whereby every seven filled magazines are followed by three empty ones and at the end again two times ten magazines remain empty.

The method and the device of the present invention are advantageous in that sheets with any desired number of banknotes can be processed without having to contemplate any resetting or modification of the magazine drums 20*a* and 20*b*, so that the average velocity of rotation of the magazine drums remains constant and the machine efficiency L depending on the number of banknotes per sheet is given by the formula $L=60(m\times n)/4(m+1)$ bundles per minute. This corresponds, with $m=10$, $n=6$ and therefore with a maximum number of 60 banknotes per sheet, to 82 bundles or 82,000 banknotes per minute, and with m=6, n=4, that is with 24 banknotes per sheet, to 51 bundles or 51,000 banknotes per minutes.

What is claimed is:

1. A method of automatically processing piles of numbered sheets of security papers comprising a plurality of banknotes or the like, with matrix-forming notes arranged in m rows and n columns, belonging to different series of security paper, which consists in forming packets of bundles of sequentially numbered security papers, whereby one pile, in which all superimposed banknotes are numbered sequentially, comprise m strip piles of n banknotes each, cutting all the strip piles cyclically into bundles delivered sequentially to an intermediate storage device comprising at least one magazine drum having N magazines distributed uniformly along its outer periphery, said drum being rotatably driven at an average speed such that the incoming bundles arrive sequentially at the successive magazines and that in a predetermined magazine a predetermined number of bundle-packet forming bundles belonging to the same series are piled up, and removing said bundle packet from the magazine drum and feeding it to a packing machine, wherein (a) in a manner known per se all the strip piles belonging to the same pile of sheets are assembled and simultaneously moved forward as a group of contiguous strip piles in the longitudinal direction of the strip piles and delivered to the bundle cutting unit, and the bundles leaving said cutting unit are fed steadily and sequentially onto a conveyor path for delivery to an intermediate storage device, (b) the number N of magazines is equal to the maximum number ($m_o \times n_o$) of banknotes contained in a single sheet to be processed, $m_o$ denoting the maximum number of rows of banknotes and $n_o$ the maximum number of column of banknotes, and (c) when m is less than $m_o$ and/or n is less than $n_o$, after cutting each group of m strip piles, ($n_o - n$) blank cycles are introduced to provide with respect to the next group of strip piles pertaining to the following pile of sheets a gap equal to the measurements of ($n_o - n$) banknotes in the longitudinal direction of the strip pile, and during the subsequent forward delivery of a bundle onto the conveyor path there are introduced into said path and at each sequence m of bundles a number ($m_o - m$) of empty positions and, on account of the aforesaid blank cycles ($n_o - n$), in addition to the last series of bundles belonging to a pile of sheets, a number $(m_o - m) + (n_o - n)\, m_o$ of empty positions.

2. A device for carrying out the method disclosed in claim 1, wherein the number of magazines of the magazine drums is equal to the number $N = (m_o \times n_o)$, electronically programmable means being provided for inserting said blank cycles and/or empty positions between successive series of bundles.

* * * * *